US006041557A

United States Patent [19]

Brown et al.

[11] Patent Number: 6,041,557

[45] Date of Patent: Mar. 28, 2000

[54] QUICK ASSEMBLY ROOF CURB APPARATUS

[75] Inventors: J. Lane Brown, Fort Smith; W. Carrol Basham, Greenwood; Phillip G. Brown, Fort Smith; Bradford B. Davenport, Greenwood, all of Ark.

[73] Assignee: Rheem Manufacturing Company, New York, N.Y.

[21] Appl. No.: 09/167,851

[22] Filed: Oct. 7, 1998

[51] Int. Cl.[7] ..... E04D 13/03

[52] U.S. Cl. ..... 52/60; 52/200; 52/282.2; 52/285.3; 52/285.4; 52/587.1; 52/656.9; 52/657; 52/712; 52/715

[58] Field of Search ..... 52/60, 200, 282.2, 52/285.3, 285.4, 587.1, 656.9, 657, 712, 715

[56] References Cited

U.S. PATENT DOCUMENTS

| | | |
|---|---|---|
| 764,487 | 7/1904 | Morrison . |
| 1,600,981 | 9/1926 | Goddard . |
| 1,867,107 | 7/1932 | Schmidt, Jr. . |
| 1,919,780 | 7/1933 | Fairbank . |
| 2,168,911 | 8/1939 | Meyer . |
| 2,340,545 | 2/1944 | Marsh . |
| 2,423,955 | 7/1947 | Widener . |
| 2,490,018 | 12/1949 | Davis . |
| 2,596,181 | 5/1952 | Soderberg et al. . |
| 2,765,159 | 10/1956 | Garofalo . |
| 3,113,358 | 12/1963 | Zell et al. . |
| 3,414,224 | 12/1968 | Robilliard et al. . |
| 3,802,131 | 4/1974 | Resech . |
| 3,879,144 | 4/1975 | Eckerbrecht . |
| 4,053,245 | 10/1977 | Wright . |
| 4,199,907 | 4/1980 | Bains et al. . |
| 4,335,973 | 6/1982 | Beck et al. . |
| 4,423,978 | 1/1984 | Tiegelmann . |
| 4,507,815 | 4/1985 | Danko . |
| 4,781,008 | 11/1988 | Lyons, Jr. . |
| 4,835,935 | 6/1989 | Murphy . |
| 5,016,406 | 5/1991 | Calam et al. . |
| 5,148,647 | 9/1992 | Rutledge . |
| 5,188,333 | 2/1993 | Schumacher et al. . |
| 5,255,887 | 10/1993 | Schumacher et al. . |
| 5,465,533 | 11/1995 | Rummo, Jr. et al. . |

*Primary Examiner*—Christopher T. Kent
*Attorney, Agent, or Firm*—Konneker & Smith, P.C.

[57] ABSTRACT

The four metal panel portions of an air conditioning unit roof curb have spaced sets of inwardly projecting lanced portions positioned adjacent their ends and defining tab-receiving slots. With the panel portions in a rectangular assembly orientation, specially designed drive cleats are used to lock the contiguous ends of the panel portions together at the corners of the curb. Each cleat has spaced pairs of tabs which, when the cleat is downwardly driven into place on a corner section of the curb, sequentially enter vertically successive pairs of slots in the contiguous panel end portions at the corner. In this manner, only one tab pair and one slot pair need to be aligned with one another before the cleat is driven into place to lock the two contiguous panel end portions to one another, the initial tab pair/slot pair alignment serving to automatically align the successive tab and slot pairs as the cleat is driven home. A pair of the tabs on each drive cleat have dimples thereon which function as detent structures that releasably lock the cleat tabs in their panel slots and thereby releasably retain the drive cleat in place on the assembled roof curb. In an alternate embodiment of the drive cleats, side halves thereof are formed integrally with ends of the panel portions, with the tabs of the integrally formed cleat halves being sequentially insertable into the tab-receiving lance slots of adjacent panel end portions.

26 Claims, 3 Drawing Sheets

QUICK ASSEMBLY ROOF CURB APPARATUS

BACKGROUND OF THE INVENTION

The present invention generally relates to heating and air conditioning equipment and, in a preferred embodiment thereof, more particularly relates to roof curbs used to underlie and operatively support heating and air conditioning units on a roof.

Frame-shaped structures commonly referred to as roof curbs are typically used to support heating and air conditioning units on roofs to supply heated or cooled air to conditioned spaces below the roof. The typical roof curb has a rectangular frame body portion which is comprised of four side wall portions which are secured together at the job site, the assembled body portion extending above the roof and forming a base structure upon which a heating and air conditioning may be operatively placed.

As conventionally assembled, the four side wall portions of the curb are bolted or screwed together at the corners of the curb, with all of the fasteners being manually put into place at the job site. As is well known in the industry, this traditional method of constructing a roof curb is a time-consuming and relatively expensive task.

A previously proposed solution to these problems associated with the use of threaded fasteners to intersecure the side wall portions at the corners of a roof curb is illustrated and described in U.S. Pat. No. 5,148,647 to Rutledge in which a hinge-like structure is integrally formed on the ends of the roof curb side wall portions and configured to be joined together with pin structures driven into the hinge structures at the four corners of the roof curb. While this hinge/pin corner joining structure tends to speed up the overall roof curb assembly process, the pins used in securing the corners, as well as the formation of the hinge joints at the side wall ends, tend to be undesirably expensive. Moreover, the hinge portions on the contiguous curb side wall portion ends must be precisely aligned by hand to properly receive the pin driven into the hinge portions.

In view of these problems, limitations and disadvantages typically associated with conventional techniques for assembling roof curbs it can readily be seen that a need exists for further improvements in such assembly techniques. It is to this need that the present invention is directed.

SUMMARY OF THE INVENTION

In carrying out principles of the present invention, in accordance with a preferred embodiment thereof, quick assembly roof curb apparatus is provided that comprises a frame body structure including first and second side wall portions each having a length and an end. These first and second side wall portions are positionable in an assembly orientation in which their ends are in a contiguous relationship, with the side wall portions representatively being at a right angle to each other.

The first and second side wall portions, which are useable with two other side wall portions to form a rectangular frame of the overall roof curb, carry spaced first connector structures, representatively inwardly lanced portions, adjacent the ends thereof. These first connector structures, with the first and second side wall portions being in their assembly orientation, are grouped in a first pair disposed on opposite sides of the contiguous side wall portion ends, and a second pair disposed on opposite sides of the contiguous ends and being spaced from the first pair in a first direction transverse to the lengths of the first and second side wall portions.

A specially designed connector member, representatively in the form of a plate-shaped drive cleat, is provided and is useable to lock the first and second side wall portions in their assembly orientation. The connector member has spaced first and second pairs of second connector structures thereon, representatively tab members, which are positioned and configured to be sequentially and interlockingly engaged with the first and second pairs of first connector structures, respectively, in response to an operative movement of the connector member relative to the first and second side wall portions in the aforementioned direction transverse to the lengths of the first and second side wall portions.

Because of the relative spacings between the pairs of first and second connector structures which provides for this sequential engagement, only one pair of first connector structures and one pair of second connector structures need to be aligned with one another prior to the connector member being driven home. This serves to make the connection of the frame side wall portions to one another, and thus the assembly of the overall roof curb, easier and faster.

According to another feature of the invention, a detent structure is formed on at least one of the second connector structures to releasably hold it in operative locking engagement with its associated first connector structure. Additionally, a cross-piece structure is preferably secured to the assembled frame body structure using lanced portions of the side wall portions that receive tab portions of the cross-piece structure.

In a preferred embodiment thereof, the drive cleat has a generally plate-shaped body portion having top and bottom ends spaced apart in a first direction, and first and second spaced apart vertical side edge portions on which bottom, vertically intermediate and top pairs of downwardly projecting connector tabs are formed, the tabs being receivable in corresponding slots in lanced portions Of the frame side wall portions. The lanced portions are arranged in vertically spaced bottom, vertically intermediate and top pairs on the first and second side wall portions of the frame, representatively at a corner thereof. The lanced portions in each pair thereof are vertically aligned with one another and are each positioned on a different side wall portion end. The vertical spacing between the bottom lance pair and the vertically intermediate lance pair is equal to the vertical spacing between the vertically intermediate lance pair and the top lance pair.

The cleat tabs in each pair thereof are positioned on different ones of the first and second cleat body side edges, with the bottom ends of the vertically intermediate tab pair being vertically spaced apart from the bottom ends of the bottom cleat pair a first distance greater than the vertical lance pair-to-pair spacing, and the bottom ends of the top tab pair being vertically spaced apart from the bottom ends of the vertically intermediate tab pair a second distance greater than the first distance. In this manner, only the bottom tab pair of tabs need to be aligned with the bottom pair of lances before the cleat is driven home to cause the sequential and respective receipt of the bottom, vertically intermediate and top cleat tabs within the slots of the bottom, vertically intermediate and top lance pairs.

The drive cleat representatively has an angled body and is used at the corners of a rectangular roof curb frame. It could, however, have a generally planar body and be used to join roof curb frame side wall sections in an end-to-end relationship in which the lengths of these side wall sections were essentially parallel to one another.

Additionally, while the unique sequential engagement of the drive cleat connector structures with the roof curb frame side wall portion connector structures is representatively achieved using equal vertical spacing between the side wall portion connector structure pairs and unequal vertical spacing between the drive cleat connector structure pairs, it will be appreciated by those of skill in this particular art that these spacing relationships could be reversed so that the vertical spacing between the drive cleat connector structure pairs was equal, with the vertical spacing between the frame side wall portion connector structure pairs being unequal.

In another preferred embodiment of the invention, one side of the drive cleat structure is anchored to, and preferably formed integrally with the end of one of the first frame side wall portion and has outer side edge tabs which are sequentially engageable with the lanced connector structures on the end of the second side wall portion. Preferably, this side portion of the drive cleat structure projects transversely outwardly from the end of the first side wall portion.

DETAILED DESCRIPTION

Figure 1:
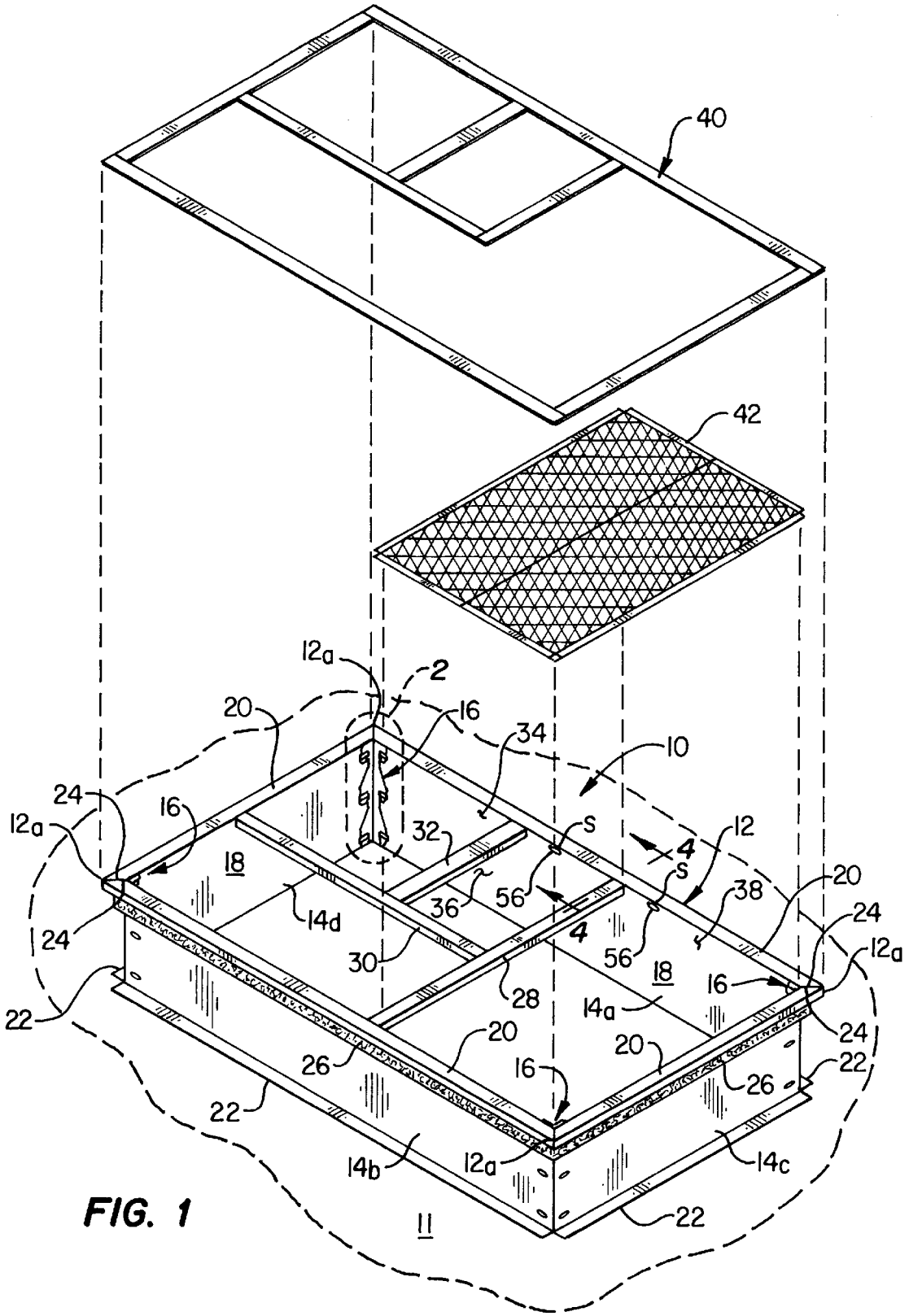
FIG. 1 is a partially exploded perspective view of a roof curb assembly incorporating therein, at its corner joints, a specially designed multi-tab drive cleat embodying principles of the present invention.

Referring initially to FIG. 1, the present invention provides a specially designed quick assembly roof curb 10 which is used to underlie and operatively support, for example, a heating and air conditioning unit (not illustrated) on a roof 11 to provide heated or cooled air, as needed, to a conditioned space beneath the roof. Roof curb 10 includes a rectangular frame 12 having corners 12*a* and being defined by four elongated metal panel members 14*a*–14*d* which are joined at the frame corners 12*a* by four specially designed drive cleat fasteners 16 as later described herein.

Each of the metal side wall panel portions 14*a*-14*d* has a vertically oriented body portion with an inner side 18, a horizontally outwardly extending top edge flange 20, and a horizontally outwardly extending bottom edge flange 22. Each of the flanges 20,22 is mitered at its opposite ends, as at 24. With the frame 12 in its assembled state, the bottom panel flanges 22 rest on supporting joists or beams (not shown) below the roof 11, and the top flanges 20 are disposed somewhat above the top surface of the roof 11. Wood nailer strips 26 are suitably secured to the outer side surfaces of the panels 14*a*-14*d*, just below the top edge flanges 20, and serve as nailing bases for adjacent flashing and counterflashing portions of the overall roof structure.

As later described herein, horizontal frame cross pieces 28,30,32 are secured within a top interior side portion the frame 12 and define at the top side of the roof curb 10 a return air opening 34, a supply air opening 36, and a condenser mounting area 38 at the right end of the roof curb 10. A rectangular gasket structure 40 is positioned atop the top edge flanges 20 and the cross pieces 28, 30 and 32, and a conventional insulation panel 42 is placed over the condenser mounting area 38. The heating and air conditioning unit (not shown) is suitably supported on the top side of the assembled roof curb 10, with its supply air outlet opening over the roof curb opening 36, its return air inlet opening over the roof curb opening 34, and its condenser portion over the insulation panel 42.

Figure 2B:
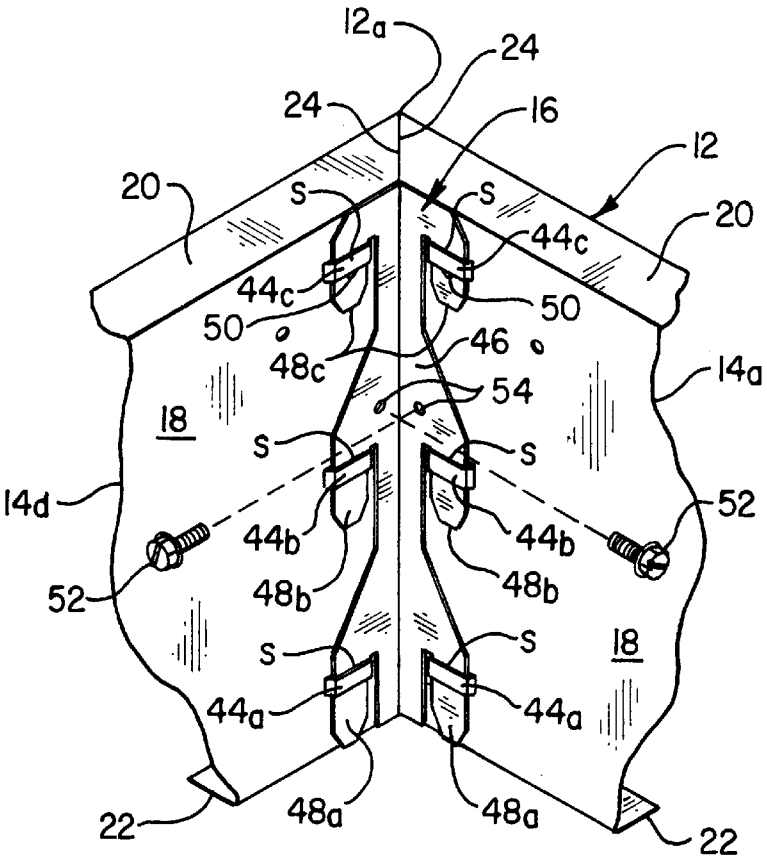
FIGS. 2A and 2B are enlarged scale perspective detail views of the dashed line area "2" in FIG. 1 and sequentially illustrate the installation of the tabs of one of the corner drive cleats in associated lance slot portions of contiguous side wall panel sections of the roof curb.
Figure 2A:
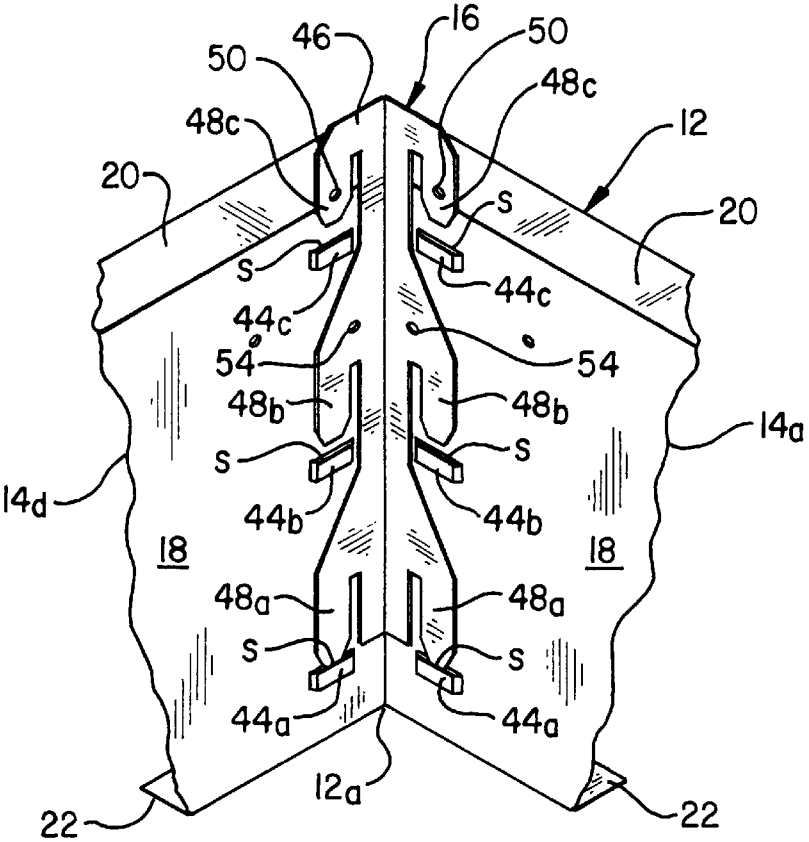

FIGS. 2A and 2B show the drive cleat 16 used at the corner 12*a* formed by facing ends of the two panel members 14*a* and 14*d* in their pre-assembly orientation. FIG. 2A illustrates the drive cleat 16 just prior to its locking engagement with the facing ends of panel members 14*a* and 14*d*, and FIG. 2B illustrates the drive cleat 16 after it has been installed on the facing ends of panel members 14*a*,14*d* and releasably locks them together.

Adjacent their facing ends, each panel member 14*a*,14*d* has three vertically spaced, horizontally oriented lance portions projecting inwardly from its inner side 18—a bottom lance portion 44*a*, a vertically intermediate lance portion 44*b*, and an upper lance portion 44*c*. Each lance portion 44*a*,44*b*,44*c* forms a tab slot S between the lance portion and the inner side 18 of its associated panel member 14*a* or 14*d*. As illustrated in FIG. 2A, the bottom lance portions 44*a* are disposed in a vertically aligned pair on opposite sides of their associated frame corner 12*a*, the vertically intermediate lance portions 44*b* are disposed in a vertically aligned pair on opposite sides of their associated frame corner 12*a*, and the upper lance portions 44*c* are disposed in a vertically aligned pair on opposite sides of their associated frame corner 12*a*. The vertical spacing between the pair of bottom lance portions 44*a* and the pair of vertically intermediate lance portions 44*b* is identical to the vertical spacing between the pair of vertically intermediate lance portions 44*b* and the pair of upper lance portions 44*c*.

The drive cleat 16 illustrated in FIGS. 2A and 2B is typical of the four drive cleats used in the rectangular roof curb 10 and has a right angled, plate-shaped, vertically elongated body 46 that longitudinally extends parallel to the drive axis of the cleat and has, on each vertical outer side edge thereof, three vertically spaced apart depending fastening tabs which are horizontally aligned with one another—a bottom tab 48*a*, a vertically intermediate tab 48*b*, and an upper tab 48*c*. As illustrated, the bottom tabs 48*a* are disposed in a vertically aligned pair on opposite side edges of the cleat body 46, the vertically intermediate tabs 48*b* are disposed in a vertically aligned pair on opposite side edges of the cleat body 46, and the top tabs 48*c* are disposed in a vertically aligned pair on opposite side edges of the cleat body 46.

The tab pairs 48*a*,48*b*,48*c* are respectively and slidably insertable downwardly into the slots S of the lance portion pairs 44*a*,44*b*,44*c*. For purposes later described herein, the vertical distance between the bottom ends of the pair of bottom tabs 48*a* and the bottom ends of the pair of vertically intermediate tabs 48*b* is greater than the vertical distance between the top sides of the pair of bottom lance portions 44*a* and the top sides of the pair of vertically intermediate lance portions 44*b*, and the vertical distance between the bottom ends of the pair of vertically intermediate tabs 44*b* and the bottom ends of the pair of top tabs 44*c* is greater than the vertical distance between the bottom ends of the pair of vertically intermediate tabs 44*b* and the bottom ends of the pair of bottom tabs 44*a*.

To perpendicularly join the adjacent pair of ends of the panel side wall members 14*a*,14*d* at their associated frame corner 12*a*, the facing mitered ends of the two panel members 14*a*,14*d* are placed in an abutting relationship, and the drive cleat 16 is interiorly positioned at the corner 12*a* with the lower ends of the bottom drive cleat tabs 48*a* (see FIG. 2A) just above the bottom lance portions 44*a*. The drive cleat 16 is then longitudinally driven downwardly from its FIG. 2A starting position to its FIG. 2B installed position to respectively drive the cleat tab pairs 48*a*,48*b*,48*c* into the slots S of their associated underlying lance portion pairs 44*a*,44*b*,44*c* and releasably lock the two panel members 14*a*,14*d* together at their facing ends. The three other drive cleats 16 are used in similar manners at the other three frame corners 12*a*.

Because of the unique vertical tab spacing of the drive cleat 16 relative to the vertical spacing of the lance portions 44*a*,44*b* and 44*c*, the drive cleat tab pairs 48*a*,48*b*,48*c* sequentially enter the slots S of the lance portion pairs 44*a*,44*b*,44*c* as the cleat 16 is driven from its FIG. 2A position downwardly to its FIG. 2B installed position. Accordingly, only the bottom two cleat tabs 48*a* need to be initially aligned with their associated lance portions 44*a* before the cleat 16 is pounded home. The initial alignment of the tabs 48*a* and lance portions 44*a* automatically aligns the remaining tabs with the remaining lance portion slots S as the tabs 48*b* approach their underlying lance portions 44*b*, and the tabs 48*c* later approach their underlying lance portions 44*c*. This substantially simplifies and quickens the installation of each drive cleat 16, in turn simplifying and quickening the overall assembly of the roof curb 10.

Once each drive cleat 16 is downwardly driven into its FIG. 2B installed position, dimples 50 formed on sides of each of the cleat's upper tabs 48*c* pass downwardly through and past their associate upper lance portions 44*c* and then function as resilient detent-type holding structures that releasably retain the installed drive cleat 16 in place. If desired, this installed drive cleat holding structure may be augmented by self-tapping screws 52 which are passed through holes 54 in the drive cleat 16 and threaded into underlying portions of the joined side wall panel members 14*a*,14*d*.

Figure 3:
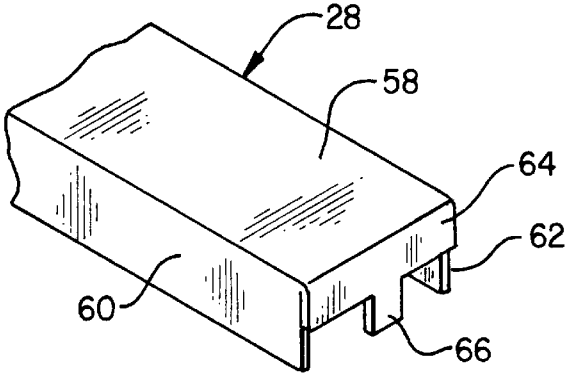
FIG. 3 is an enlarged scale perspective view of an end portion of one of the curb cross pieces shown in FIG. 1.
Figure 4:
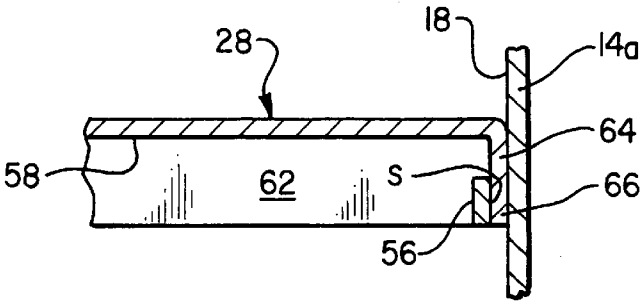
FIG. 4 is an enlarged scale cross-sectional view through the cross piece end portion taken along line 4—4 of FIG. 1.

Referring now to FIGS. 1, 3 and 4, to further quicken and simplify the assembly of the roof curb 10, various additional inwardly projecting lance portions 56 are formed in selected locations on the panel members 14, adjacent their upper side edge flanges 20, and define tab-receiving slots S within the interior of the frame 12. These additional lance portions 56 are used to facilitate the rapid attachment of the cross-piece structure 28,30,32 to the frame 12.

FIGS. 3 and 4 illustrate the manner in which a portion of the cross-piece structure 28,30 and 32, representatively a right end portion of the cross-piece member 28, is attached to one of the auxiliary lance portions 56 in panel member 14*a*. As illustrated, the cross-piece 28 has an elongated rectangular top side wall 58 having a pair of downturned side edge flanges 60 and 62, and a downturned end flange 64. End flange 64, at its left and right sides (as viewed in FIG. 3) is notched to formed a downturned central connection tab 66. A similar tab is formed on the opposite end of the cross-piece 28. After the frame 12 has been assembled, the cross-piece end tab 66 is simply slipped downwardly into the slot S of the lance portion 56 (see FIG. 4), with other cross-piece end tabs being similarly slipped into other lance portions 56, to rapidly and easily connect the cross-piece structure to the frame 12.

As can be readily seen from the foregoing, the use of the specially designed drive cleats 16 makes the assembly of the roof curb frame 12 a quite simple and rapid operation. The fabrication of the cleats 16 and the lance structures 44 and 56 may be economically achieved using simple metal stamping processes. Additionally, the use of the dimples 50 releasably retains the drive cleats 16 in place, but at the same time permits the easy removal of the cleats by simply moving one panel member 14 vertically relative to a contiguous panel member 14 at one of their corner joints 12*a*. Also, as previously mentioned, the use of the auxiliary lance portions 56 speeds up and simplifies the installation of the cross-piece structure 28,30,32.

While the relative spacing between the drive cleat tab pairs 48*a*,48*b*,48*c* and the associated lance portion pairs 44*a*,44*b*,44*c* which permits the tab pairs 48*a*,48*b*,48*c* to respectively and sequentially enter the slots S of the lance portion pairs 44*a*,44*b*,44*c* is preferably achieved using uniform vertical spacing between the lance portion pairs 44*a*, 44*b*,44*c* and using nonuniform vertical spacing between the drive cleat pairs 48*a*,48*b*,48*c*, it will be appreciated that this sequential insertion result could also be achieved using a uniform tab pair vertical spacing and a nonuniform lance pair vertical spacing scheme. Furthermore, this relative spacing and sequential engagement between first and second connector structure pairs could also be achieved using first and second interengageable connector structures having configurations different than the illustrated tab and slot configurations respectively used on the drive cleat and the side wall panel portions of the roof curb frame 12.

Figure 5:
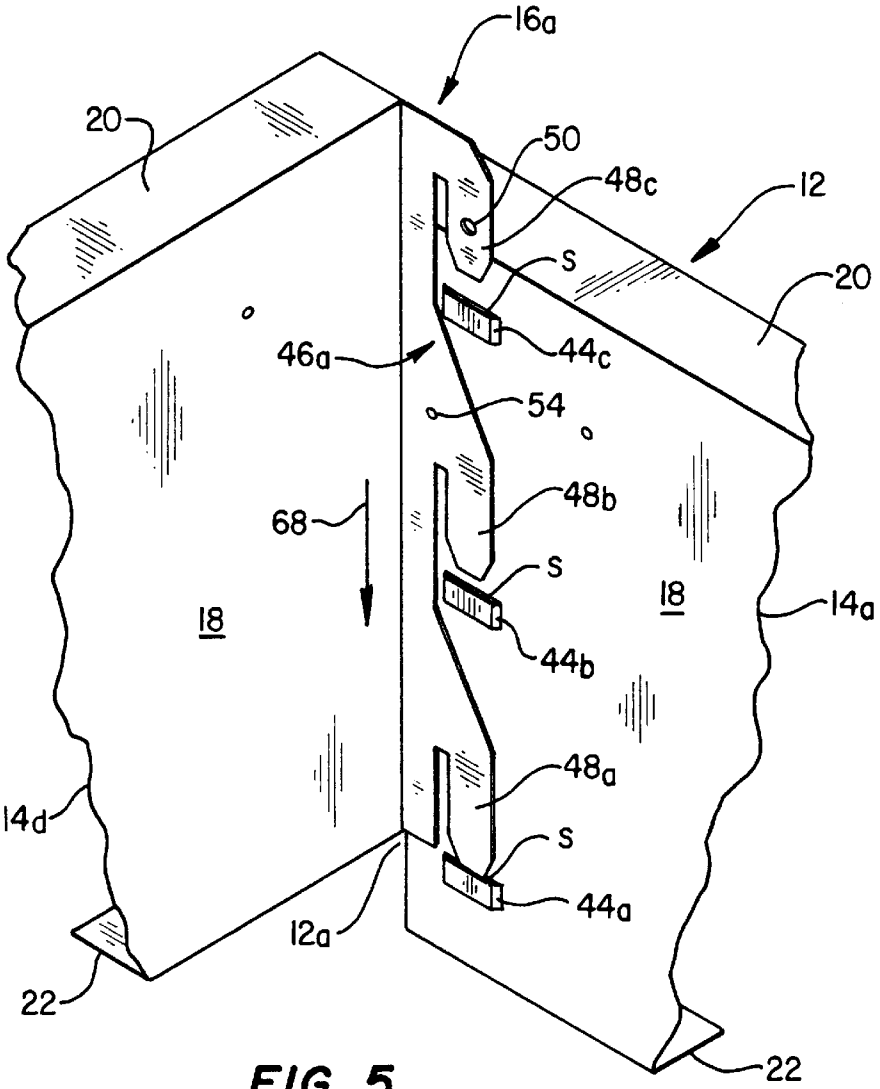
FIG. 5 is an enlarged scale perspective detail view similar to FIG. 2A but illustrating the use of an alternate embodiment of the drive cleat in which a horizontal side portion thereof is formed integrally with one of the side wall panel sections of the roof curb.

An alternate embodiment 16*a* of the previously described drive cleat fastener structure 16 is perspectively illustrated in FIG. 5. In this drive cleat embodiment, a horizontal side portion 46*a* of the drive cleat body 16 is formed integrally with and transversely projects outwardly from the illustrated end of the metal panel member 14*d*, with the depending outer side edge tabs 48*a*,48*b*,48*c* on the integral drive cleat body portion 46*a* being downwardly and sequentially receivable in the slots S of the lance portions 44*a*,44*b*,44*c* on the panel member 14*a* as the cleat end of the panel member 14*d* is driven downwardly relative to the panel member 14*a* as illustrated by the arrow 68 in FIG. 5. As previously described for the separate drive cleat 16, the passage of the dimple 50 on the cleat tab 48*c* releasably retains the ends of illustrated panel members 14*a*,14*d* in their aligned, assembled relationship.

The foregoing detailed description is to be clearly understood as being given by way of illustration and example only, the spirit and scope of the present invention being limited solely by the appended claims.

What is claimed is:

1. Roof curb apparatus useable to construct a roof curb, comprising:

a frame body structure including first and second side wall portions each having a length and an end, said first and second side wall portions being positionable in an assembly orientation in which said ends are in a contiguous relationship;

spaced first connector structures carried by said first and second side wall portions adjacent said ends thereof, said first connector structures, with said first and second side wall portions in said assembly orientation, being grouped in a first pair disposed on opposite sides of the contiguous ends, and a second pair disposed on opposite sides of the contiguous ends and being spaced from said first pair in a direction transverse to said lengths; and a connector member useable to lock said first and second side wall portions in said assembly orientation, said connector member having spaced first and second pairs of second connector structures thereon which are positioned and configured to be sequentially and interlockingly engaged with said first and second pairs of first connector structures, respectively, in response to an operative movement of said connector member relative to said first and second side wall portions in said direction.

2. The roof curb apparatus of claim 1 wherein, with said first and second wall portions in said assembly orientation, said lengths are at an angle relative to one another.

3. The roof curb apparatus of claim 2 wherein said angle is a right angle.

4. The roof curb apparatus of claim 1 wherein:

said first and second side wall portions are first and second panel members, and said first connector structures are formed integrally with said first and second panel members.

5. The roof curb apparatus of claim 4 wherein said second connector structures are receivable within said first connector structures.

6. The roof curb apparatus of claim 5 wherein:

said first connector structures are lanced portions of said first and second panel members, and said second connector structures are spaced apart tab portions of said connector member.

7. The roof curb apparatus of claim 1 further comprising a detent structure carried by one of an interlockable pair of said first and second connector structures and operative to releasably hold said interlockable pair of said first and second connector structures in interlocked engagement.

8. The roof curb apparatus of claim 7 wherein:

said second connector structure in said interlockable pair is releasably receivable in said first connector structure in said interlockable pair, and said detent structure includes a projection formed on said second connector structure in said interlockable pair.

9. The roof curb apparatus of claim 1 wherein said first and second pairs of said second connector structures are interlockingly engaged with said first and second pairs of first connector structures.

10. The roof curb apparatus of claim 1 further comprising:

a cross-piece structure having an end portion, and cooperatively engageable structures on said end portion and said first side wall portion for releasably securing said end portion to said first side wall portion.

11. The roof curb apparatus of claim 10 wherein said cooperatively engageable structures include:

a tab disposed on said end portion, and a lanced portion disposed on said first side wall portion and forming a slot operative to releasably receive said tab.

12. A drive cleat for use in connecting two side wall panel portions of a roof curb, comprising:

a body portion having top and bottom ends spaced apart in a first direction, and first and second side wall portions spaced apart in a second direction transverse to said first direction;

a bottom pair of downwardly projecting connector tabs each positioned on a different one of said first and second side portions, having bottom ends, and being aligned with one another in said first direction;

a vertically intermediate pair of downwardly projecting connector tabs spaced upwardly apart from said bottom pair of connector tabs, said vertically intermediate pair of connector tabs being positioned on different ones of said first and second side portions, having bottom ends spaced upwardly apart a first distance from said bottom ends of said bottom connector tabs, and being aligned with one another in said first direction; and a top pair of downwardly projecting connector tabs spaced upwardly apart from said vertically intermediate pair of connector tabs, said top pair of connector tabs being positioned on different ones of said first and second side portions, having bottom ends spaced upwardly apart a second distance from said bottom ends of said vertically intermediate connector tabs, and being aligned with one another in said first direction, said second distance being greater than said first distance.

13. The drive cleat of claim 12 wherein at least one of said connector tabs has a side surface with a detent projection formed thereon.

14. The drive cleat of claim 12 wherein said body portion is of a generally plate-shaped configuration, and said first and second side portions have outer side edge portions on which said bottom, vertically intermediate and top pairs of connector tabs are formed.

15. The drive cleat of claim 14 wherein said first and second side portions form an angle with one another.

16. The drive cleat of claim 15 wherein said angle between said first and second side portions is a right angle.

17. Roof curb apparatus useable to construct a roof curb, comprising:

a frame body structure including first and second side wall portions each having a length and an end, said first and second side wall portions being positionable in an orientation in which said ends are in an adjacent relationship;

first and second spaced apart connector structures carried by said first side wall portion adjacent said end of said first side wall portion; and connector apparatus useable to operatively join said first and second side wall portions, said connector apparatus having third and fourth spaced apart connector structures thereon which are positioned and configured to be sequentially and interlockingly engaged with said first and second connector structures, respectively, in response to a driven movement of said connector apparatus relative to said first side wall portion when said first and second side wall portions are in said orientation thereof.

18. The roof curb apparatus of claim 17 wherein said connector apparatus is a connector member removably connectable to said ends of said first and second side wall portions.

19. The roof curb apparatus of claim 18 wherein said connector apparatus is a drive cleat member.

20. The roof curb apparatus of claim 19 wherein said drive cleat member has a generally plate-shaped body, said third and fourth connector structures are side edge tab portions of said body, and said first and second connector structures are lanced portions of said first and second side wall portions.

21. The roof curb apparatus of claim 20 wherein one of said tab portions has a detent projection on a side surface thereof.

22. The roof curb apparatus of claim 17 wherein said connector apparatus is anchored to said end of said second side wall portion.

23. The roof curb apparatus of claim 22 wherein said connector apparatus is formed integrally with said end of said second side wall portion.

24. The roof curb apparatus of claim 22 wherein said connector apparatus has a plate-like body projecting outwardly from said end of said second side wall portion and has an outer side edge, said third and fourth connector structures are tabs formed on said outer side edge, and said first and second connector structures have slot portions configured to releasably receive said tabs.

25. The roof curb apparatus of claim 24 wherein said body projects transversely outwardly from said end of said second side wall portion.

26. The roof curb apparatus of claim 24 wherein one of said tabs has a detent projection on a side surface thereof.

* * * * *